United States Patent [19]

Theys

[11] 4,083,203

[45] Apr. 11, 1978

[54] KNITTING PROCESS UTILIZING MULTI-LEVEL PRESSER FOOT

[75] Inventor: Andre P. Theys, Wondelgem, Belgium

[73] Assignee: Fabrique Nationale Herstal S.A., Herstal, Belgium

[21] Appl. No.: 773,225

[22] Filed: Mar. 1, 1977

[30] Foreign Application Priority Data

May 31, 1976 Belgium ..... 55071

[51] Int. Cl.[2] ..... D04B 7/04

[52] U.S. Cl. ..... 66/64

[58] Field of Search ..... 66/64, 60, 147, 198, 66/199, 157

[56] References Cited

U.S. PATENT DOCUMENTS

| | | | |
|---|---|---|---|
| 2,434,782 | 1/1948 | Alexander et al. | 66/147 |
| 3,007,324 | 11/1961 | Bram | 66/64 |
| 3,049,900 | 8/1962 | Bram | 66/60 |
| 3,153,922 | 10/1964 | Bram | 66/64 |
| 3,613,401 | 10/1971 | Jeffcoat et al. | 66/60 |
| 3,685,317 | 8/1972 | Giachetti | 66/64 |
| 3,839,884 | 10/1974 | Flavell et al. | 66/64 |
| 3,842,623 | 10/1974 | Flavell et al. | 66/64 |
| 3,952,553 | 4/1976 | Kohler | 66/64 |
| 3,973,416 | 8/1976 | Kohler | 66/64 |

FOREIGN PATENT DOCUMENTS

| | | | |
|---|---|---|---|
| 619,967 | 4/1927 | France | 66/64 |
| 340,005 | 9/1959 | Switzerland | 66/64 |
| 382,361 | 11/1964 | Switzerland | 66/64 |

*Primary Examiner*—Mervin Stein
*Assistant Examiner*—Andrew M. Falik
*Attorney, Agent, or Firm*—Bacon & Thomas

[57] ABSTRACT

A process for knitting a composite piece or panel on a straight bar knitting machine with double needle bed, provided with a presser foot device that is adjustable to operate at either of two preselected levels, each level corresponding to a level suitable for rib or jersey knitting, the piece or panel comprising at least one area of jersey knitting and one area of rib border knitting, characterized by the fact that it comprises the steps of starting a first knitting operation with the presser foot at the most appropriate level for the first area of knitting to be manufactured (rib or jersey); subsequently locating the presser foot at a second level which is adapted to the second area of knitting (jersey or rib) and continuing the knitting operation without interrupting the overall knitting operation of the machine to knit the other area of the piece or panel.

6 Claims, 18 Drawing Figures

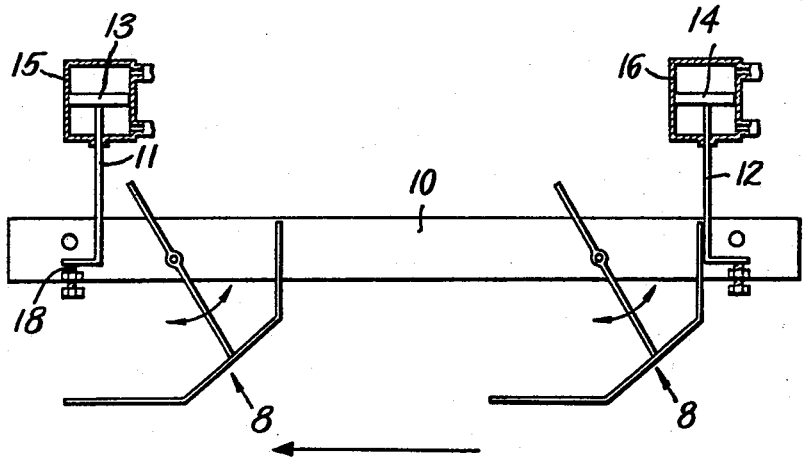
Fig. 15
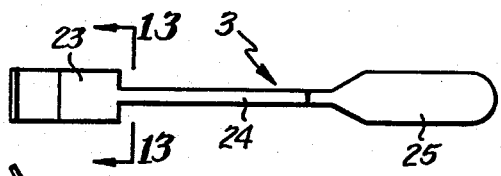
Fig. 16
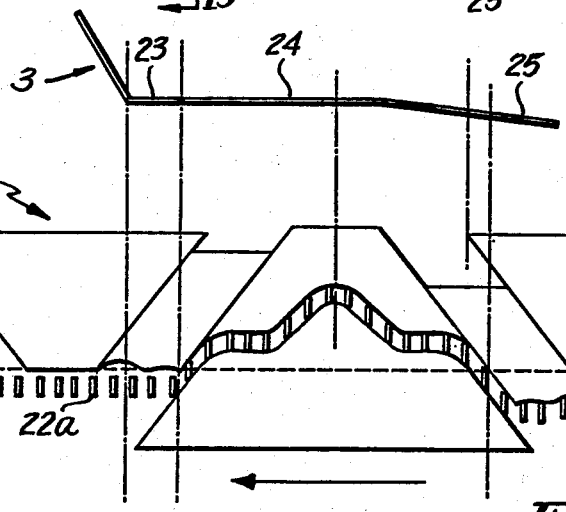
Fig. 17
Fig. 18

KNITTING PROCESS UTILIZING MULTI-LEVEL PRESSER FOOT

BACKGROUND OF THE INVENTION

The present invention pertains to a novel knitting process which permits the fabrication of composite knitwear on double V-shaped needle bed knitting machines equipped with presser foot devices.

By composite knitwear is meant such knitwear which comprises jersey areas as well as rib border areas in panel or tubular form.

In prior art machines, it was only possible until now to knit either jersey or rib border during a single knitting machine operation on machines using a presser foot device. Knitting of jersey and rib required a presser foot device of specific shape and located at a specific operating level. This is fully explained in U.S. Pat. No. 3,613,401 to JEFFCOAT et al. The only solution known by applicant for obviating this drawback consisted in knitting a false rib border by including an elastic thread in the jersey knitting. This is hardly a satisfactory solution.

BRIEF SUMMARY OF THE INVENTION

The purpose of the present invention is to provide a process for allowing the fabrication of aforesaid two types of knitting during the same machine operation, so as to obtain a composite knitwear with rib and jersey knit areas which requires practically no further finishing operation.

The process according to the invention utilizes a knitting machine fitted with a specific presser foot device in which includes means for adjusting the presser foot to operate at two different levels while the machine is operating. Such a device is described, for instance, in applicant's BELGIAN Patent No. 840,229 laid open for public inspection on Sept. 30, 1976 and which further corresponds with applicant's copending U.S. Pat. application Ser. No. 771,337 filed on Feb. 23, 1977.

This novel knitting process generally comprises locating the presser foot at a level which is most appropriate for the first area (rib or jersey) of knitwear to be manufactured; knitting this first area; subsequently automatically locating the presser foot at a second level best adapted for a second area of knitwear that is different from the first area (jersey or rib), and in knitting this second area, all of the foregoing during a continuous knitting machine operation.

With this basic process as a starting point, it is possible to realize the knitting of a great number of different combinations, examples of which are described hereinafter.

BRIEF DESCRIPTION OF THE DRAWINGS

The appended drawings schematically illustrate three different applications of the process in accordance with the present invention.

FIG. 15 shows an adjusting system for varying the level of operation of a pair of presser feet while the machine is operative;

FIGS. 16 and 17 show a specific presser foot particularly adapted for utilization in the process of this invention; and FIG. 18 shows the operative relationship between the presser foot of FIGS. 1 and 2, and the cam box of one of the needle beds, during a typical knitting stroke.

DETAILED DESCRIPTION

Figure 1:
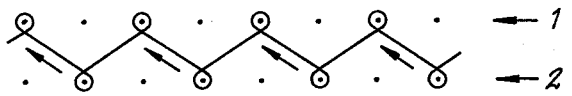
FIGS. 1 to 5 illustrate schematically the characteristic stages of a process according to the invention for knitting two rib borders, followed by knitting a tubular part in jersey connected to the rib borders.
Figure 2:
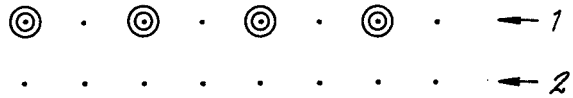
Figure 3:
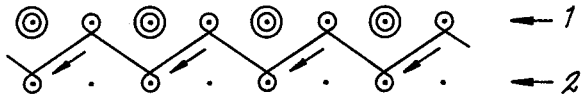
Figure 4:
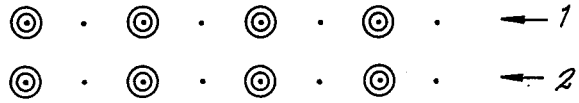
Figure 5:
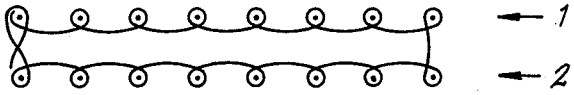
Figure 13:
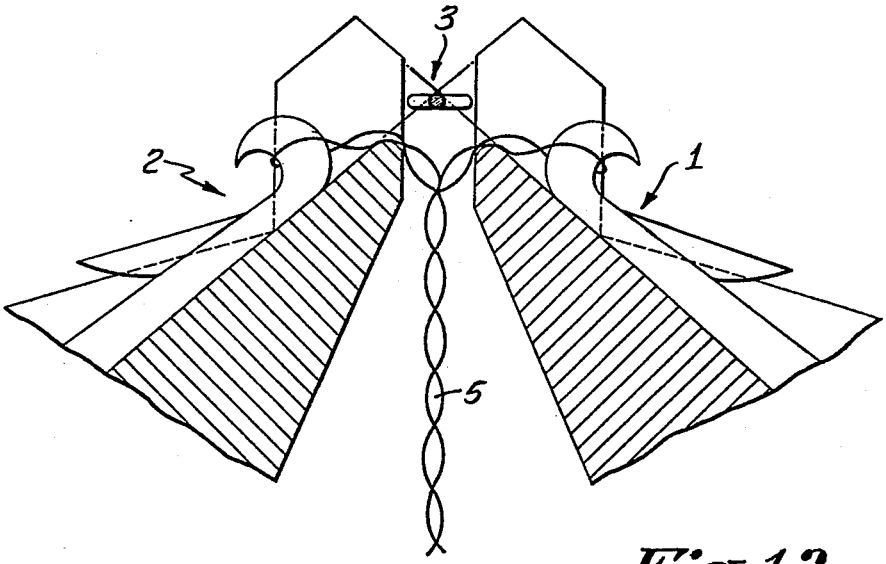
FIGS. 13 and 14 show a flat V bed needle machine in the loop forming area with a presser foot operating at two preselected levels.
Figure 14:
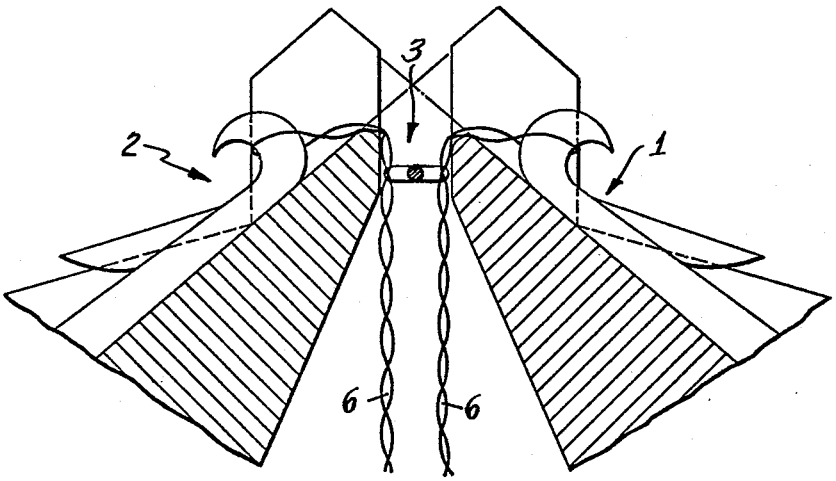

In the example of FIGS. 1 to 5, a first rib border is first knitted in the usual manner on the needles of the two needle beds 1 and 2 which are shown in FIG. 13. The loops are next transferred from one needle bed, such as for instance needle bed 2, to the occupied needles of needle bed 1 as shown in FIG. 2. Next, the second rib border is knitted on those needles of the two needle beds which had remained free (FIG. 3). Next, the loops of this second rib border are transferred from the needle beds of needle bed 1 to the occupied needles of needle bed 2 (FIG. 4). Subsequently, a jersey area is knitted on all of the needles of the two needle beds (FIGS. 5 and 14) during the same machine operation as the aforesaid knitting operations. Between the rib knitting and jersey knitting steps, the operating level of presser foot 3 is automatically changed from a first level suitable for rib border knitting, as shown in FIG. 13, to a second level suitable for jersey knitting as shown in FIG. 14. In FIGS. 13 and 14, the rib border knit is shown at 5 and 6, respectively. In FIG. 14, the connected rib knit is not shown, but if illustrated would appear as two rib panels connected to the bottom of tubular knit fabric panel 6. This process enables continuous knitting of the composite panel during a continuous knitting machine operation. That is, manual intervention to change the presser foot element while the machine is stopped is eliminated.

Figure 6:
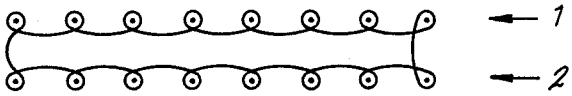
FIGS. 6 to 8 shows a tubular jersey knitting process, followed by a rib border knitting process.
Figure 7:
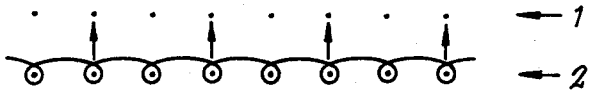
Figure 8:
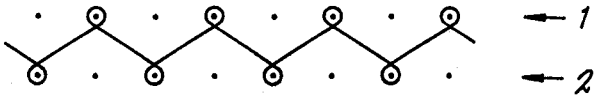

In a second example of a process in accordance with the invention, a tubular jersey is first knitted on the needles of the two needle beds (FIGS. 6 and 14). The loops from the even needles of needle bed 2 are then transferred to the corresponding needles of needle bed 1, after knocking off (FIG. 7). The knitwear is finally completed by a single rib border (FIGS. 8 and 13).

Figure 9:
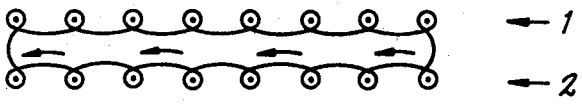
FIGS. 9 to 12 illustrate the knitting of a tubular knitwear followed by the knitting of two connected rib borders.
Figure 10:
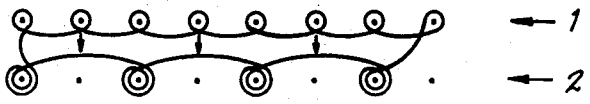
Figure 11:
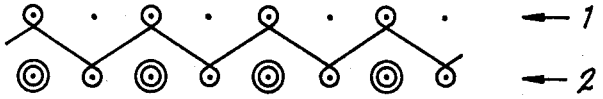
Figure 12:
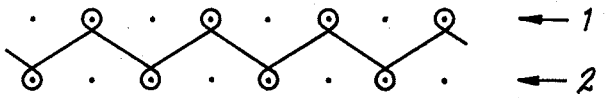

According to the third example, one starts by a jersey tubular knitting (FIGS. 9 and 14). The loops of the even needles of needle bed 2 are transferred to the odd needles of this same needle bed, and the even loops of needle bed 1 are then transferred to the needles which have just been freed on needle bed 2 (FIG. 10). A rib border is then knitted (FIG. 11) and, after knocking off, a second rib top is knitted on the needles which have not taken part in the knitting on the first rib border (FIG. 12).

In each case, the pressor foot will be located at the appropriate level prior to the knitting of the jersey or rib border.

The steps of the above-described examples may well be carried out in reverse order. Other combinations can be also taken into consideration. Moreover, any desired widening and narrowing operations, either symmetrically or not, can be carried out.

Composite articles can thus be obtained, such as sweaters or similar articles, the articles requiring only very slight finishing operations, or even none at all.

When the last knitting to be performed is a rib border, it is advantageous to terminate by a transfer of the loops from one needle bed to the free needles of the other needle bed, and subsequently to knit a plurality of rows of jersey, so as to allow an easy and rapid finishing of the article. In order to induce the jersey tubular knitwear to roll up on the correct side of an attached rib border, it may be advantageous to carry out a double transfer.

FIG. 15 shows an arrangement for varying the operative level of presser foot elements 8, which are shown in the same environment as the presser foot elements shown in U.S. Pat. No. 3,613,401. A bar 10 is moveable in time with the cam box of one of the needle beds and the presser foot elements 8 are attached to the bar 10 to reciprocate between the needle beds. A pair of fluid actuators 15, 16 having pistons 13, 14 are connected to bar 10 by piston rod 12. Fine adjustments are provided at 18 to make small adjustments to the level of bar 10 at its preselected operating levels. The actuators 15, 16 as illustrated reciprocate with the bar 10 and are also controllable through suitable conventional machine program control means (not illustrated) to raise and lower bar 10 and presser foot elements 8 to either of two operating levels suitable for a rib or jersey knitting operation. The operating levels are shown in FIGS. 13 and 14, respectively; however, FIGS. 13 and 14 show a specific embodiment of presser foot that is described in FIGS. 16–18. As illustrated, in FIG. 15, the presser foot elements 8 are set to move along a left-to-right stroke.

In FIGS. 16 through 18, a specific form of presser foot 3 especially adapted to the process recited in this application is illustrated, along with its relationship to a cam box 22 of one of the needle beds that is set to move along a leftward stroke as viewed in FIG. 18 to cause movement of the needle buts **22*a*** in the conventional manner to form loops of yarn during a knitting operation. The specific presser foot apparatus illustrated forms the subject matter of applicant's copending application cited above.

In actuality, FIG. 13 shows the presser foot 3 at approximately section 13—13 of FIG. 16. The extreme upturned left end of the presser foot 3, of course, is not active, but is connected to the bar 10 in a manner similar to the presser foot 8 illustrated in FIG. 15.

Presser foot 3 includes active sections 23, 24, 25, all as described in applicant's copending United States application and his BELGIAN Publication. The specific function of the active sections 23, 24, and 25 does not form a part of the claimed subject matter of this application.

What is claimed is:

1. A process for knitting a composite article including connected rib knit and jersey knit areas during a continuous knitting operation of a knitting machine having a double needle V bed and a presser foot capable of being automatically adjusted during the operation of the machine to operate at either of two preselected levels that are respectively suited for rib or jersey knitting, comprising (a) adjusting the operating level of the presser foot machine at a level best suited for knitting the first area (rib or jersey) of the article;

(b) knitting the first area of the article;

(c) adjusting the operating level of the presser foot at a second level best suited for knitting the second area (jersey or rib) of the article, said second area having a different knit pattern than the first area;

(d) knitting the second area of the article;

(e) all of the steps (a) through (d) being carried out during the said knitting operation of the machine.

2. A knitting process according to claim 1, wherein step (b) comprises knitting a first rib border area on the alternate needles of both needle beds, transferring the loops of said first rib border area from one needle to the occupied needles of the other needle bed, knitting a second rib border area on the free needles of both needle beds, and transferring the loops of the second rib border from one said needle bed to the occupied needles of said first needle bed; and wherein step (d) comprises knitting jersey on the needle beds.

3. A knitting process according to claim 2, wherein step (b) comprises knitting a tubular jersey knit area on the needle beds and transferring, after knocking off, the loops of alternate needles from one of the needle beds to the other needle bed; and wherein step (d) comprises knitting a rib border on both needle beds.

4. A knitting process accoding to claim 1, wherein step (b) comprises knitting tubular jersey on the needles, transferring loops from alternate needles of one needle bed to next adjacent alternate needles of the other needle bed, transferring the single loops on alternate needles of the first needle bed to the free needles of the one bed; and wherein step (d) comprises knitting a rib border area on the needle beds using the needles holding the last knit loops.

5. A knitting process according to claim 3, including the added steps of transferring loops of last knitted rib border area from one needle bed to the unoccupied needles of the other needle bed, and knitting a plurality of rows of jersey on the other needle bed.

6. A knitting process according to claim 3, includng the added steps of transferring loops of last knitted rib border area from one needle bed to the unoccupied needles of the other needle bed, transferring all of the loops of the last knitted border area to the said one needle bed; and knitting a plurality of rows of jersey on said one needle bed.

* * * * *